US005636556A

United States Patent [19]

Friedlander et al.

[11] Patent Number: 5,636,556

[45] Date of Patent: Jun. 10, 1997

[54] DEVICE FOR CONDITIONING AND SHARPENING THE BLADE OF A SCRAPER TOOL

[76] Inventors: Harry Friedlander, P.O. Box 837-1007, San Jose, Costa Rica; Henry K. Lanz, 415 E. 85th St., New York, N.Y. 10028; Nolton C. Johnson, P.O. Box 837-1007, San Jose, Costa Rica

[21] Appl. No.: 267,151

[22] Filed: Jun. 27, 1994

[51] Int. Cl.[6] ..... B21K 5/12

[52] U.S. Cl. ..... 76/89.2; 76/88

[58] Field of Search ..... 76/82, 82.2, 84, 76/88, 89, DIG. 9, 83, 89.2; 51/3, 149, 156, 181 R; 451/455, 452

[56] References Cited

U.S. PATENT DOCUMENTS

| | | | |
|---|---|---|---|
| 102,994 | 5/1870 | Webster . | |
| 317,591 | 5/1885 | Stone | 76/84 |
| 441,758 | 12/1890 | Gowdy . | |
| 823,279 | 6/1906 | Kellogg | 76/88 |
| 1,190,718 | 7/1916 | Brunsell et al. . | |
| 1,324,512 | 12/1919 | Maurer | 451/555 |
| 1,612,323 | 12/1926 | Staats-Oels | 451/555 X |
| 3,575,068 | 4/1971 | Stafford | 76/82.2 |
| 4,494,340 | 1/1985 | Carter | 451/555 |
| 4,498,360 | 2/1985 | Milum . | |
| 4,558,540 | 12/1985 | Collins | 451/555 |
| 4,934,110 | 6/1990 | Juranitch . | |
| 5,099,722 | 3/1992 | Lee . | |
| 5,157,879 | 10/1992 | Fletcher | 76/88 X |

FOREIGN PATENT DOCUMENTS

| | | |
|---|---|---|
| 293785 | 3/1928 | United Kingdom . |

OTHER PUBLICATIONS

"Harris Scraper Blade Conditioner Does It All", from p. 74, item A of The 1994 Garrett Wade Tool Catalog, Sep. 1993–Sep. 1994.

*Primary Examiner*—Rinaldi I. Rada
*Attorney, Agent, or Firm*—Plevy & Assocaites

[57] ABSTRACT

A handheld tool used for conditioning and sharpening the blade of a scraping tool or like tool. The present invention tool includes a tool body that supports a file, a sharpening stone, a conditioning pin and a burnishing element. A plurality of slots are disposed within the tool, wherein each of the slots intersect the burnishing element at a different angle between 90° and 75°. The tool provides guiding surfaces that enable a blade to be properly worked against the file, the sharpening stone, and the conditioning pin. The step of burnishing the blade is accomplished by passing the blade through one of the slots formed in the tool. As a result, the labor and time needed to sharpen a blade is greatly reduced and the quality of the blade point is made more consistent.

11 Claims, 3 Drawing Sheets

DEVICE FOR CONDITIONING AND SHARPENING THE BLADE OF A SCRAPER TOOL

BACKGROUND OF THE INVENTION

1. Field of the Invention

The present invention relates to handheld tools that can be used to condition and sharpen the cutting edge of a cabinet scraper blade or like tool blade. More particularly, the present invention relates to a tool that embodies a file and a sharpening stone for conditioning the edge of a blade and a consolidating pin and burnishing rod for creating a desired hooked configuration to the edge of the blade.

2. Prior Art Statement

Tools such as cabinet scrapers, hide scrapers and the like use planar blades wherein the sharpened edge of the blade is slightly hooked so as to cut into the material over which the tool is drawn. Forming the proper hook onto the sharpened edge of such a tool is traditionally a difficult and time consuming task that takes a great degree of skill. The task is complicated by the fact that the degree of the hook is changed depending upon the task being preformed with the tool. For instance, with cabinet scrapers, a large hook would be used for paint or varnish stripping, while a much smaller hook would be used for marquetry or cleaning raised grain for finishing.

Traditionally, the conditioning and sharpening of a scraper tool blade is a four step process that requires four separate tools. The first step in conditioning a scraper blade is to square the blade edge by passing the cutting edge of the blade over a fine tooth file. This step is traditionally called jointing and is performed until the scraper edge is flat with no discernable nicks or shear marks. Next, the edge of the scraper blade is passed over a sharpening stone which removes any roughness from the edge left by the file during jointing. In both the jointing step and the sharpening stone step, it is very important that the plane of the scraper is perpendicular to the plane of the file or sharpening stone. As such, great care is taken in mounting the file, stone or blade in a jig or vice to ensure the proper orientational configurations. This adds greatly to the time it takes to condition such a blade.

After the cutting edge of a scraper blade is conditioned on the sharpening stone, a consolidating pin is passed over the now flat edge of the blade. This causes the edge of the blade to become work hardened to a predetermined degree depending upon both how firmly the blade is biased against the consolidating pin, and how many times the conditioning pin is passed over the blade. Once the edge is work hardened to a desired degree, a burnishing rod is stroked along the hardened edge of the blade at an angle between 0° and 25°. The burnishing rod hones an edge, thereby creating the desired hook-shaped configuration. The degree in size of the hook is dependent upon the angle of the burnishing rod in forming the hook.

In the prior art there are many devices that assist a person in forming the desired hooked edge on a scraper blade. Such prior art is exemplified by U.S. Pat. No. 102,994 to Webster, entitled SHARPENING MACHINE and U.S. Pat. No. 5,099,722 to LEE, entitled CABINET SCRAPER BURNISHING TOOL. In both references a tool is shown that helps perform the burnishing step of the before described traditional blade conditioning technique. However, these prior art tools require that a scraper blade first be jointed, stone stroked and conditioning pin stroked before these tools can be used to burnish an edge. Consequently, the quality of the burnished edge is high but there is little reduction in the time and labor needed to obtain such a burnished edge.

Accordingly, a need exists in the art for a single tool that can perform all of the steps required in conditioning and sharpening a scraper blade. Such a tool will eliminate the cost of multiple tools and the skills need to handle those tools, thereby producing considerable cost and labor savings.

SUMMARY

The present invention is a handheld tool used for conditioning and sharpening the blade of a scraping tool or like tool. The present invention tool includes a tool body that supports a file, a sharpening stone, a conditioning pin and a burnishing element. A plurality of slots are disposed within the tool, wherein each of the slots intersect the burnishing element at a different angle between 90° and 75°. The tool provides guiding surfaces that enable a blade to be held flush against the file, the sharpening stone, and the conditioning pin. Accordingly, the skill, time and labor needed to consistently and accurately file, stone stroke and condition the blade is greatly reduced. The step of burnishing the blade is accomplished by passing the blade through one of the slots formed in the tool. Since the slot is at a predetermined angle relative to the burnishing element, the blade is burnished at the desired angle with a minimum of skill. As a result, the labor and time needed to sharpen a blade is greatly reduced and the quality of the blade point edge is made more consistent.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE PRESENT INVENTION

Although the present invention can be used to condition and sharpen many types of blades that are used to scrape various materials, the present invention is especially suitable for use in sharpening the blades of cabinet scrapers used in woodworking. Accordingly, the present invention will be described in conjunction with a traditional cabinet scraper blade.

Figure 1:
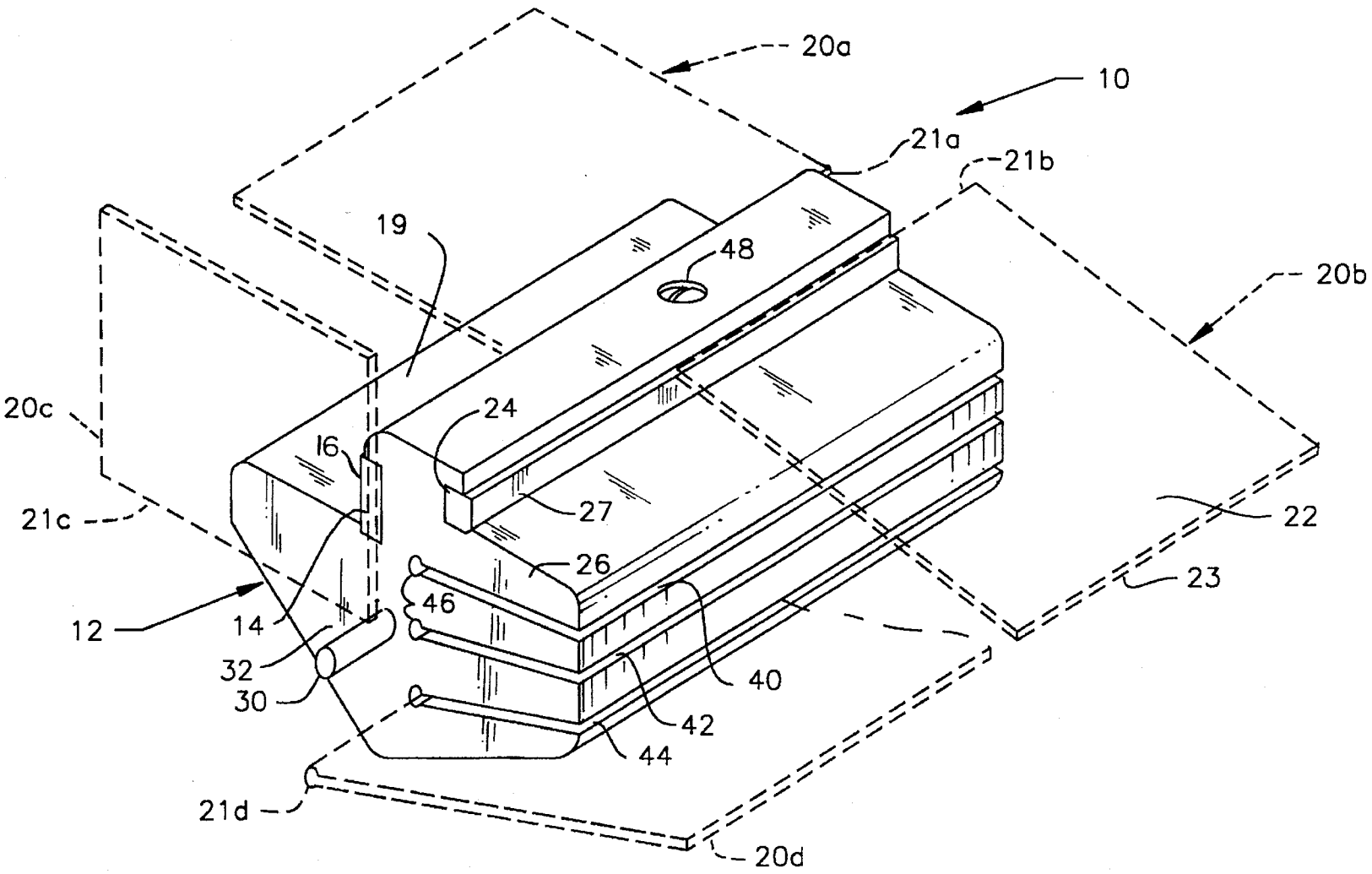
FIG. 1 is a perspective view of one preferred embodiment of the present invention tool shown in conjunction with ghost images of scraper blades to demonstrate operation and facilitate discussion.

Referring to FIG. 1, a first preferred embodiment of the present invention tool 10 is shown. The body 12 of the tool 10 can be made of wood, plastic or metal. However, if metal is used it is preferable that the metal selected is significantly softer than the metal of the scraper blade being conditioned. Accordingly, the scraper blade will not be scratched as it is passed over the various surfaces of the tool 10, as will later be explained.

A file 14 is disposed within the tool 10 in such a manner that the face surface 16 of the file 14 is exposed. The file 14 can be molded into place, mechanically joined to the body 12 of the tool 10 and/or adhesively held into place depending upon the material of the tool body 12. A first surface 19 of the tool body 12 intersects the face surface 16 of the file 14 at a perpendicular. Accordingly, when the scraper blade 20*a* is laid flush against the first surface 19, the cutting edge 21*a* of the scraper blade 20*a* faces the file 14. By stroking the scraper blade 20*a* back and forth along the first surface 19 of the tool body 12, the cutting edge 21*a* of the scraper blade 20*a* can be worn against the file 14, thereby preforming the traditional first step of jointing the scraper blade 20*a*. This jointing action removes all nicks and unevenness from the cutting edge 21*a* until the cutting edge 21*a* lays flush against the file 14 in a plane perpendicular to the plane of the scraper blade 20*a*. Although the term file is used, it should be understood that the file 14 could be any abrasive surface capable of wearing away the material of the scraper blade 20*a*.

A stone 24 or similar fine abrasion element is disposed on the tool body 12 at a point different from the file 14. The stone 24 can be held into position on the tool body 12 by any mechanical and/or adhesive means. A second surface 26 of the tool body 12 intersects the stone 24 at a perpendicular to the working surface 27 of the stone 24. Accordingly, after the scraper blade 20*b* has been jointed against the file 14, the scraper blade 20*b* can be placed flush against the second surface 26 and the cutting edge 21*b* can be conditioned against the stone 24. When the scraper blade 20*b* is placed against the second surface 26, the plane of the scraper blade 20*b* lays perpendicular to the working surface 27 of the stone 24. By stroking the scraper blade 20*b* back and forth along the second surface 26, the cutting edge 21*b* of the scraper blade 20*b* is further conditioned. This further refines the cutting edge 21*b*, removing any scoring on the cutting edge 21*b* left by the file 14.

After the scraper blade 20*b* is jointed against the file 14, it will be understood that burrs may occur on the top and bottom surfaces 22, 23 of the scraping blade 20*b* adjacent to the cutting edge 21*b*. To remove such burrs, the scraper blade 20*b* can be reoriented 90° from the shown position against the stone 24 so that the cutting edge 21*b* of the scraper blade 20*b* lays against the second surface 26 and either the top or bottom surface 22, 23 of the scraping blade 20*b* lays against the working surface 27 of the stone 24. By moving the scraper blade 20*b* back and forth against the stone 24 in this orientation, all the burrs on the top and bottom surfaces 22, 23 of the scraper blade 20*b* can be removed.

A conditioning pin 30 extends from a side surface 32 of the tool body 12. In the preferred embodiment, the conditioning pin 30 is made of a material that has a hardness greater than that of the material of the scraping blade 20*c*. The cutting edge 21*c* of the scraping blade 20*c* is passed along the conditioning pin 30 to slightly work harden the cutting edge 21*c*. The degree of work hardening achieved is dependent upon how hard the cutting edge 21*c* is pressed against the conditioning pin 30 and how many times the cutting edge 21*c* is passed over the conditioning pin 30. The side surface 32 of the tool body 12 acts as a guide by orienting the plane of the scraper blade 20*c* at a perpendicular to the longitudinal axis of the conditioning pin 30.

Figure 2:
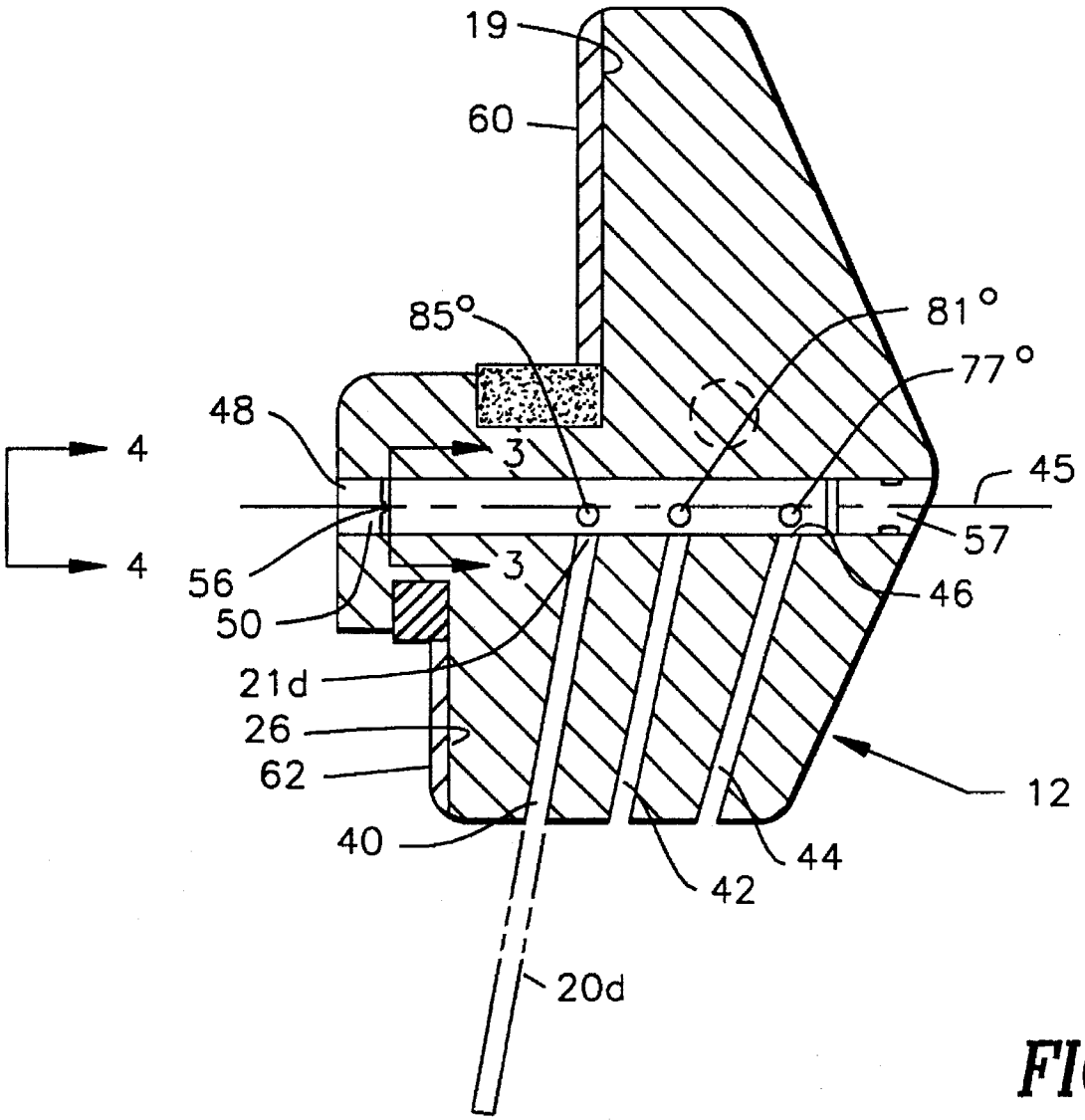
FIG. 2 is a cross-sectional view of the embodiment of FIG. 1, viewed along section line 2—2.

After a desired degree of work hardening has been obtained along the cutting edge 21*c*, the cutting edge 21*c* is burnished to the desired hooked shape. Referring to FIG. 2 in conjunction with FIG. 1 it can be seen that three slots 40, 42, 44 are formed in the tool body 12. Each slot has a width that enables the scraper blade 20*d* to be passed therethrough. Each of the slots 40, 42, 44 terminates with an enlarged end 46 that accommodates the hardened cutting edge 21*d* of the scraper blade 20*d* that was created after being passed over the conditioning pin 30. An aperture 48 extends through the tool body 12. The aperture 48 communicates with the enlarged ends 46 of each of the slots 40, 42, 44. Looking toward FIG. 2, it can be seen that the first slot 40 is oriented at an 85° angle relative to the longitudinal axis 45 of the aperture 48. The second slot 42 is oriented at an 81° angle relative to the longitudinal axis 45 of the aperture 48. Lastly, the third slot 44 is oriented at a 77° angle relative to the longitudinal axis 45 of the aperture 48. It will be understood that the selected angles of 85°, 81° and 77° are preferred but greater or lesser angles may be used. Similarly, depending upon the size of the tool 10, more than three slots can be made, thereby providing additional choices.

A burnishing element 50 is placed within the aperture 48. The burnishing element 50 has a hardness greater than that of the material of the scraping blade 20*d*. Accordingly, by sliding the scraping blade 20*d* back and forth within any of the slots 40, 42, 44, the cutting edge 21*d* of the scraping blade 20*d* can be burnished against the burnishing element 50 at an angle corresponding to the angle of the slot being engaged. The angled burnishing of the mushroomed cutting edge 21*d* creates the sharpened hooked configuration required for the scraping blade. The angle of the sharpened hooked configuration depends upon in which of the slots 40, 42, 44 the scraping blade 20 is burnished. The 85° slot 40 creates a narrow 5° hooked configuration. While the 77° slot 44 creates a much more prominent 13° hooked configuration.

As can be seen in FIG. 2, the burnishing element 50 is held within the aperture 48 with a slight interference fit. The interference fit prevents the burnishing element 50 from falling out of the aperture 48, however still enables the burnishing element 50 to be rotated around the longitudinal axis 45 of the aperture 48. A screw driver kerf 56 is formed in one end of the burnishing element 50. As such, the burnishing element 50 can be rotated about the longitudinal axis 45 of the aperture 48 by engaging the kerf 56 with the head of a screw driver. To prevent the burnishing element 50 from being pushed out of the aperture 48 by the screw driver, a plug 57 may be placed in the aperture 48 to obstruct one end. The plug 57 may be press fit, threaded or otherwise retained in place. Alternatively, the aperture 48 need not be drilled through the tool body 12 but may be a blind bore, wherein the closed of the bore would act as a stop.

Also in FIG. 2, optional wear plates 60, 62 are shown mounted onto the first surface 19 and second surface 26 of the tool body 12. These wear plates 60, 62 are optional depending upon the material of the tool body 12. If the tool body 12 is metal, such wear plates 60, 62 would not be necessary. However, if the tool body 12 is wood, the wear plates 60, 62 would be preferred to prevent the movement of the scraping blade from wearing away the material of the tool body 12.

Figure 3A:
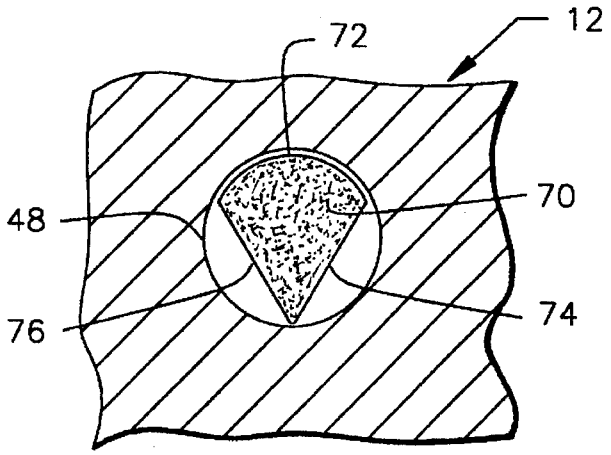
FIG. 3*a* is a segmented cross-sectional view of the embodiment of FIG. 2, viewed along section line 3—3, wherein a first alternatively shaped burnishing element is disposed within the tool.
Figure 3C:
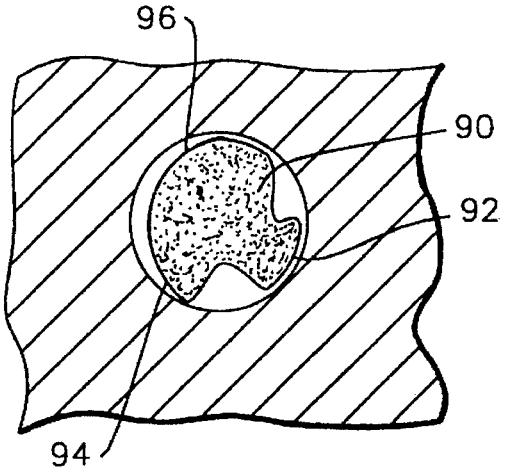
FIG. 3*c* is the same view as FIG. *a*, wherein a third alternatively shaped burnishing element is disposed within the tool.
Figure 3B:
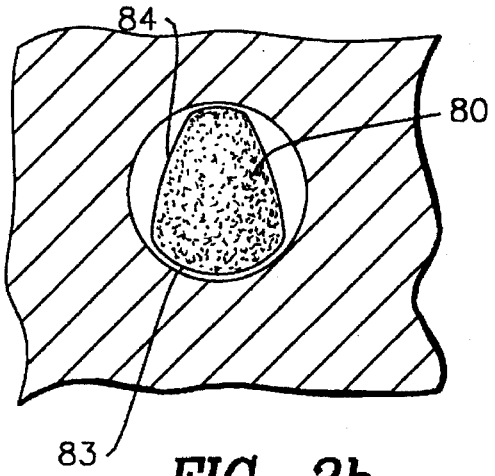
FIG. 3*b* is the same view as FIG. 3*a*, wherein a second alternatively shaped burnishing element is disposed within the tool.

In the shown embodiment of FIG. 2, a round burnishing element 50 is shown. By rotating the burnishing element 50, wear along the burnishing element 50 can be distributed and the life of the burnishing element 50 prolonged. Referring to FIG. 3*a* it can be seen that the burnishing element 70 in the aperture 48 of the tool body 12 need not be round but rather may have differently configured surfaces. With multiple surfaces, it will be understood that the cutting edge of the scraping blade can be burnished against any one of the configured surfaces depending upon how the burnishing element 70 is rotated within the aperture 48. In FIG. 3*a* the burnishing element 70 has a normal rounded surface 72 and two flat surfaces 74, 76. In FIG. 3*b* the burnishing element 80 has a normal rounded surface 83 and an elliptical surfaces 84. In FIG. 3*c* the burnishing element 90 is a combination of the previous two embodiments, having a rounded surface 92, flat surfaces 94 and an elliptical surface 96. The use of multiple configured surfaces enables the cutting edge of curved scraper blades and similar specialty blades to be conditioned and sharpened.

Figure 4:
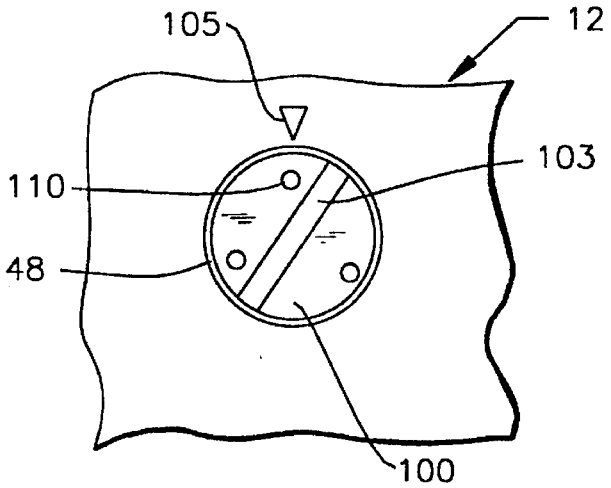
FIG. 4 is a segmented view of the embodiment of FIG. 2, viewed along section line 4—4.

Referring to FIG. 4, the end 100 of a burnishing element with multiple surfaces is shown. As with the previous burnishing elements, a kerf 103 is disposed in the end 100 to facilitate the rotation of the burnishing element with a screw driver. A position icon 105 is formed on the tool body 12 proximate the aperture 48 in which the burnishing element rests. Different colored dimples 110 are disposed on the end 100 of the burnishing element. By aligning the different dimples 110 with the position icon 105, the user of the tool can know which shaped surface of the burnishing element is directed against the scraper blade. It will be understood that the use of colored dimples is exemplary and any other identifying indicia may also be used.

The exemplary embodiments described in conjunction with the figures show the best mode of the invention as contemplated by the inventor. However, another person skilled in the art may make variations and modifications to the described embodiments utilizing functionally equivalent components and alternate configurations. All such variations and modifications are intended to be included within the scope of the present invention as defined by the appended claims.

What is claimed is:

1. A tool for conditioning the cutting edge of a scraper blade, comprising:

a tool body including a first flat surface and a second flat surface, wherein said tool body has at least one slot disposed therein, and wherein said at least one slot terminates within said tool body with an enlarged head region;

a first abrasive element coupled to said tool body, wherein a surface of said first abrasive element intersects said first flat surface in a substantially perpendicular orientation;

a second abrasive element coupled to said tool body, wherein a surface of said second abrasive element intersects said second flat surface in a substantially perpendicular orientation; and a burnishing element wherein said at least one slot intersects said burnishing element at a predetermined angle and wherein said burnishing element partially extends into each enlarged head region.

2. The tool according to claim 1, further including a conditioning pin extending from said tool body, said conditioning pin having a hardness at least as great as the scraper blade.

3. The tool according to claim 1, wherein said burnishing element has a plurality of contoured surfaces and said tool further includes an orienting means for orienting a selected one of said plurality of contoured surfaces at a predetermined positional relationship with respect to said at least one slot.

4. The tool according to claim 1, wherein said burnishing element has a longitudinal axis and said tool further includes a means for rotating said burnishing element about said longitudinal axis in said tool body.

5. The tool according to claim 1, wherein said predetermined angle is between 90 degrees and 75 degrees.

6. The tool according to claim 1, wherein said second abrasive element is less abrasive than said first abrasive element.

7. The tool according to claim 1, wherein said first abrasive element is a metal file and said second abrasive element is a sharpening stone.

8. A tool for sharpening a blade, including a tool body having at least one slot disposed therein;

a file affixed to said tool body;

a sharpening stone affixed to said tool body;

a conditioning pin extending from said tool body; and a burnishing element supported by said tool body, wherein said burnishing element has a plurality of contoured surfaces;

orienting means for orienting a selected one of said plurality of contoured surfaces of said burnishing element at a predetermined positional relationship with said at least one slot.

9. The tool according to claim 8, further including guide means for orienting the blade into a predetermined relationship relative to said file.

10. The tool according to claim 8, further including guide means for orienting the blade into a predetermined relationship relative to said sharpening stone.

11. The tool according to claim 8, further including guide means for orienting the blade into a predetermined relationship relative to said conditioning pin.

* * * * *